US007583915B2

(12) United States Patent
Ida

(10) Patent No.: US 7,583,915 B2
(45) Date of Patent: Sep. 1, 2009

(54) IMAGE FORMING APPARATUS AND METHOD FOR PRODUCING CHARGING ROLL

(75) Inventor: Akihiro Ida, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 288 days.

(21) Appl. No.: 11/656,958

(22) Filed: Jan. 24, 2007

(65) Prior Publication Data

US 2007/0189807 A1 Aug. 16, 2007

(30) Foreign Application Priority Data

Feb. 14, 2006 (JP) ..... 2006-036850

(51) Int. Cl.
*G03G 15/02* (2006.01)

(52) U.S. Cl. ..... 399/176; 399/115; 399/168; 399/174; 361/221

(58) Field of Classification Search ..... 399/176, 399/115, 168, 174; 361/221
See application file for complete search history.

(56) References Cited

U.S. PATENT DOCUMENTS 5,790,927 A * 8/1998 Ando et al. ..... 399/176
2004/0076441 A1* 4/2004 Matsuguma et al. ..... 399/26
2005/0226654 A1* 10/2005 Kosuge et al. ..... 399/176
2005/0254856 A1* 11/2005 Miura et al. ..... 399/159

FOREIGN PATENT DOCUMENTS

JP A-1-179959 7/1989

* cited by examiner

*Primary Examiner*—David M Gary
*Assistant Examiner*—Billy J Lactaoen
(74) *Attorney, Agent, or Firm*—Morgan, Lewis & Bockius LLP

(57) ABSTRACT

An image forming apparatus includes a rotatable image carrying member, on a surface of which an electrostatic latent image is formed, and a charging roll that is in contact with the image carrying member to charge the surface of the image carrying member to a prescribed potential. The charging roll has, in non-image forming areas in both end parts in an axial direction of the charging roll, large diameter parts having a larger outer diameter than an outer diameter of a center part of the charging roll, and small diameter parts having a smaller outer diameter than the outer diameter of the center part inside the large diameter parts in the axial direction. Differences in outer diameter of the large diameter part and the small diameter part from the outer diameter of the center part each is approximately 0.25% or less of the outer diameter of the center part.

5 Claims, 5 Drawing Sheets

FIG. 4

| CONCAVE AND CONVEX AMOUNT IN END PART | | NIP LOAD | | |
|---|---|---|---|---|
| CONCAVE DEPTH (%) | CONVEX DEPTH (%) | 300gf | 500gf | 700gf |
| 0mm | 0mm | ○ | ○ | ○ |
| 0mm | 0.03mm (0.25) | ○ | ○ | ○ |
| 0mm | 0.06mm (0.5) | × | △ | △ |
| 0.03mm (0.25) | 0mm | ○ | ○ | ○ |
| 0.03mm (0.25) | 0.03mm (0.25) | △ | ○ | ○ |
| 0.03mm (0.25) | 0.06mm (0.5) | × | △ | △ |
| 0.05mm (0.4) | 0mm | × | × | △ |
| 0.05mm (0.4) | 0.03mm (0.25) | × | × | × |
| 0.05mm (0.4) | 0.06mm (0.5) | × | × | × |

○ : NO ABNORMAL DISCHARGE OCCURS
△ : DISCHARGE OCCURS WHILE IMPROVED
× : ABNORMAL DISCHARGE OCCURS

IMAGE FORMING APPARATUS AND METHOD FOR PRODUCING CHARGING ROLL

CROSS-REFERENCE TO RELATED APPLICATIONS

This application is based on and claims priority under 35 USC 119 from Japanese Patent Application No. 2006-036850 filed Feb. 14, 2006.

BACKGROUND (1) Technical Field

The present invention relates to an image forming apparatus by an electrophotographic system having a contact charging roll, and a method for producing a charging roll used therein. More particularly, it relates to an improvement of such an image forming apparatus that is capable of charging stably for a prolonged period of time, and a method for producing a charging roll used therein.

(2) Related Art

In recent years, a contact charging system is being used in an image forming apparatus, such as a duplicator, and in the contact charging system, a charging member applied with a charging voltage is made in contact with an image carrying member, such as a photoreceptor drum, to transfer charge directly to the photoreceptor drum, whereby the surface to be charged of the photoreceptor drum is charged to a prescribed potential. A member having a roll form is used as the charging member, and in general, has such a structure that prescribed functional layers, such as a conductive elastic layer, a resistance controlling layer and a releasing layer, are accumulated in this order around a conductive core metal.

The charging member in a roll form (hereinafter, which is referred to as a charging roll in some cases) charges a photoreceptor drum to a prescribed potential by utilizing discharge in a minute gap in the vicinity of the contact surface with the photoreceptor drum, and therefore, it has such a problem that the surface of the photoreceptor drum is liable to be abraded and deteriorated since the discharge in the vicinity of the contact surface strongly acts on the photoreceptor drum. In the case where the photoreceptor drum has a part with a film thickness that is not uniform, and the charging roll is close to or in contact with that part, there arises such a problem that localized wear occurs therein due to concentration of discharge. It has been known that these problems are liable to occur in both end parts of the charging roll, and defects, such as leakage, occur in those parts. This is because of the following factors. Discharge in the contact charging system occurs at a part that is slightly remote from the contact part between the photoreceptor drum and the charging roll. Accordingly, upon viewing the charging part of the conventional charging roll in the circumferential direction of the drum, the charging area in the both end parts of the charging roll is broadened in the circumferential direction of the drum since the end parts are left open, and thereby the charging time becomes longer in those parts than the other parts to accelerate deterioration of the photoreceptor drum.

SUMMARY

According to an aspect of the invention, an image forming apparatus includes a rotatable image carrying member, on a surface of which an electrostatic latent image is formed, and a charging roll that is in contact with the image carrying member to charge the surface of the image carrying member to a prescribed potential. The charging roll has, in non-image forming areas in both end parts in an axial direction of the charging roll, large diameter parts having a larger outer diameter than an outer diameter of a center part of the charging roll, and small diameter parts having a smaller outer diameter than the outer diameter of the center part inside the large diameter parts in the axial direction. Differences in outer diameter of the large diameter part and the small diameter part from the outer diameter of the center part each is approximately 0.25% or less of the outer diameter of the center part.

BRIEF DESCRIPTION OF THE DRAWINGS

An exemplary embodiment of the invention will be described in detail based on the following figures, wherein:

FIG. 4 is a diagram showing measurement results of relationship of the occurrence of abnormal discharge with respect to the concave and convex amounts in the end part and the nip load;

DETAILED DESCRIPTION

An exemplary embodiment of the invention will be described below with reference to the drawings.

Figure 1:
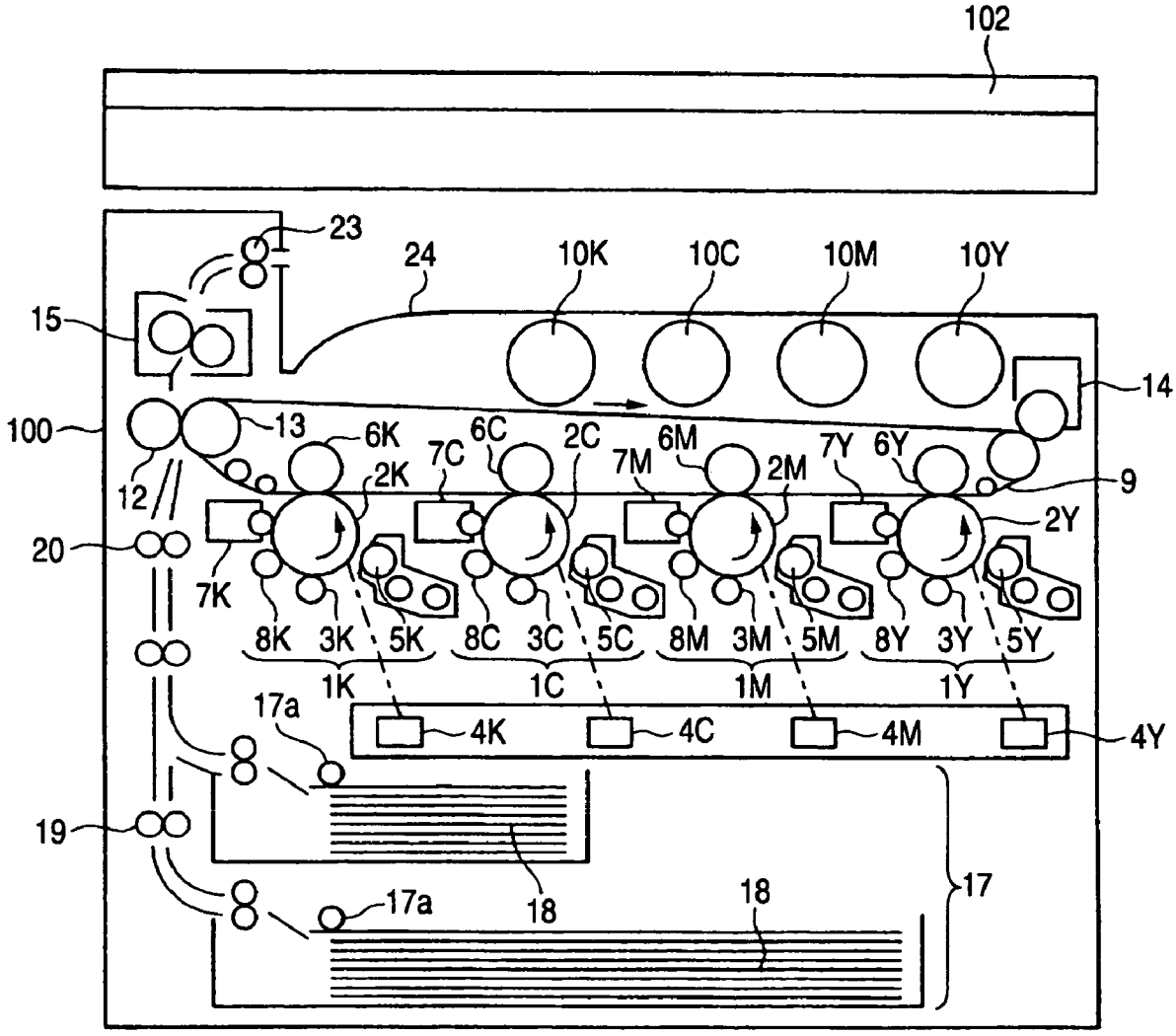
FIG. 1 is a schematic constitutional view showing an image forming apparatus according to an exemplary embodiment of the invention.

A schematic constitution of an image forming apparatus according to an exemplary embodiment of the invention will be described with reference to FIG. 1. FIG. 1 is a schematic constitutional view showing a tandem color image forming apparatus 100 according to the exemplary embodiment of the invention.

In the image forming apparatus 100, color image information of a color image of an original copy read with an image reading device 102 or color image information sent from a personal computer or an image data input device, which is not shown in the figure, input, and the image information thus input is subjected to image processing.

In FIG. 1, symbols 1Y, 1M, 1C and 1K denote image forming units for forming toner images of yellow (Y), magenta (M), cyan (C) and black (K) colors, respectively, and are disposed along an endless intermediate transfer belt 9 wound on plural tension rolls in the order of 1Y, 1M, 1C and 1K in the transporting direction thereof. The intermediate transfer belt 9 is an intermediate transfer material, on which toner images of respective colors formed sequentially in the image forming units 1Y, 1M, 1C and 1K are accumulated and transferred, and is capable of circularly moving in the direction shown by the arrow and of passing between photoreceptor drums 2Y, 2M, 2C and 2K as electrostatic latent image carrying members corresponding to the image forming units 1Y, 1M, 1C and 1K and first transfer rolls 6Y, 6M, 6C and 6K disposed to face the photoreceptor drums 2Y, 2M, 2C and 2K, respectively. The toner images of respective colors thus transferred and accumulated on the intermediate transfer belt 9 are then transferred at once to recording paper 18 as a recording medium fed from a paper feeding cassette 17 and, thereafter fixed to the recording paper 18 with a fixing device 15, followed by discharging the recording paper 18 having a color image formed thereon to an exterior of the apparatus.

The image reading device 102 herein is constituted in such a manner that an original copy placed on a glass platen is irradiated with a light source, which is not shown in the figure, an a reflected light image from the original copy is read at a prescribed resolution through a scanning optical system with an image reading element containing a CCD sensor.

The image forming units 1Y, 1M, 1C and 1K are produced to have the same constitution, and each of them is constituted roughly by a photoreceptor drum 2Y, 2M, 2C or 2K as an image carrying member that rotates in the direction shown by the arrow at a prescribed rotation speed, a charging roll 3Y, 3M, 3C or 3K as a charging unit that charges uniformly the surface of the photoreceptor drum 2Y, 2M, 2C or 2K, an exposing device 4Y, 4M, 4C or 4K that exposes the surface of the photoreceptor drum 2Y, 2M, 2C or 2K in the form of an image corresponding to the respective colors to form an electrostatic latent image, a developing device 5Y, 5M, 5C or 5K that develops the electrostatic latent image formed on the photoreceptor drum 2Y, 2M, 2C or 2K, a toner cartridge 10Y, 10M, 10C or 10K that is detachably disposed and feeds a toner of the corresponding color to the developing device 5Y, 5M, 5C or 5K, and a drum cleaning device 7Y, 7M, 7C or 7K.

In this exemplary embodiment, the photoreceptor drum 2Y, 2M, 2C or 2K contains a metallic drum rotating in the direction shown by the arrow, and coated on the surface thereof, a photosensitive layer containing an organic photosensitive material, an amorphous selenium photosensitive material or an amorphous silicon photosensitive material, and the charging roll 3Y, 3M, 3C or 3K is made in contact with the surface of the photoreceptor drum 2Y, 2M, 2C or 2K to charge the photosensitive layer to a prescribed potential with a bias containing a direct current voltage/direct current and an alternating current voltage/alternating current accumulated thereon.

The image forming process in the image forming apparatus thus constituted as described above will be described with reference to the image forming unit 1Y forming a yellow toner image as a representative example.

The photoreceptor drum 2Y is uniformly charged on the surface thereof (photosensitive layer) by applying a bias voltage/current in which an alternating current voltage/alternating current is superposed to a predetermined direct current voltage/direct current to the charging roll 3Y. The photosensitive layer is then subjected to scanning exposure corresponding to a yellow image with a laser beam output from the exposing device 4Y based, for example, on image information read by the image reading device 102, so as to form an electrostatic latent image corresponding to the yellow image on the surface (photosensitive layer) of the photoreceptor drum 2Y.

The electrostatic latent image corresponding to the yellow image is developed to a yellow toner image with the developing device 5Y and then first transferred onto the intermediate transfer belt 9 with a pressure force and an electrostatic attraction force of the first transfer roll 6Y constituting a part of a first transferring unit. The yellow toner remaining on the photoreceptor drum 2Y after the first transferring step is scraped out with the drum cleaning device 7Y. Thereafter, the surface of the photoreceptor drum 2Y is destaticized with a destaticizing device 8Y and then again charged with the charging roll 3Y for the next image formation cycle.

In the image forming apparatus 100 forming a color image with multiple colors, the similar image forming process as above is carried out also in the image forming units 1M, 1C and 1K at timings decided in consideration of the positional relationship of the image forming units 1Y, 1M, 1C and 1K, and a full color toner image obtained by accumulating the toner images is formed on the intermediate transfer belt 9. The intermediate transfer belt 9 is, for example, an endless belt formed with a flexible synthesis resin film strip, such as polyimide, both ends of which are connected by such a measure as welding.

The full color toner image thus first transferred to the intermediate transfer belt 9 is second transferred to the recording paper 18 transported to a second transfer position at a prescribed timing with a pressure force and an electrostatic attraction force of a backup roll 13 supporting the intermediate transfer belt 9 and a second transfer roll 12, which is in contact under pressure with the backup roll 13 at a prescribed timing.

The recording paper 18 having a prescribed dimension is fed with a paper feeding roll 17*a* from the paper feeding cassette 17 as a recording paper housing part disposed in the lower part of the image forming apparatus 100. The recording paper 18 thus fed is transported to the second transfer position of the intermediate transfer belt 9 at a prescribed timing with plural transporting rolls 19 and registration rolls 20. Onto the recording paper 18, the full color toner image is transferred at once from the surface of the intermediate transfer belt 9 with the backup roll 13 and the second transfer roll 12 as the second transferring unit.

The recording paper 18 having the full color toner image thus second transferred from the intermediate transfer belt 9 is separated from the intermediate transfer belt 9 and then transported to the fixing device 15 disposed on the downstream side of the second transferring unit. In the fixing device 15, the toner image is fixed on the recording paper 18 with heat and pressure. The recording paper 18 after subjecting to fixing is discharged to a paper delivery tray 24 through paper delivery rolls 23.

The residual toner remaining on the intermediate transfer belt 9 but not transferred to the recording paper 18 with the second transferring unit is transported in the state where the toner is attached to the intermediate transfer belt 9, to a belt cleaning device 14, and is then removed from the intermediate transfer belt 9 with the belt cleaning device 14 to prepare for the next image formation.

Figure 2:
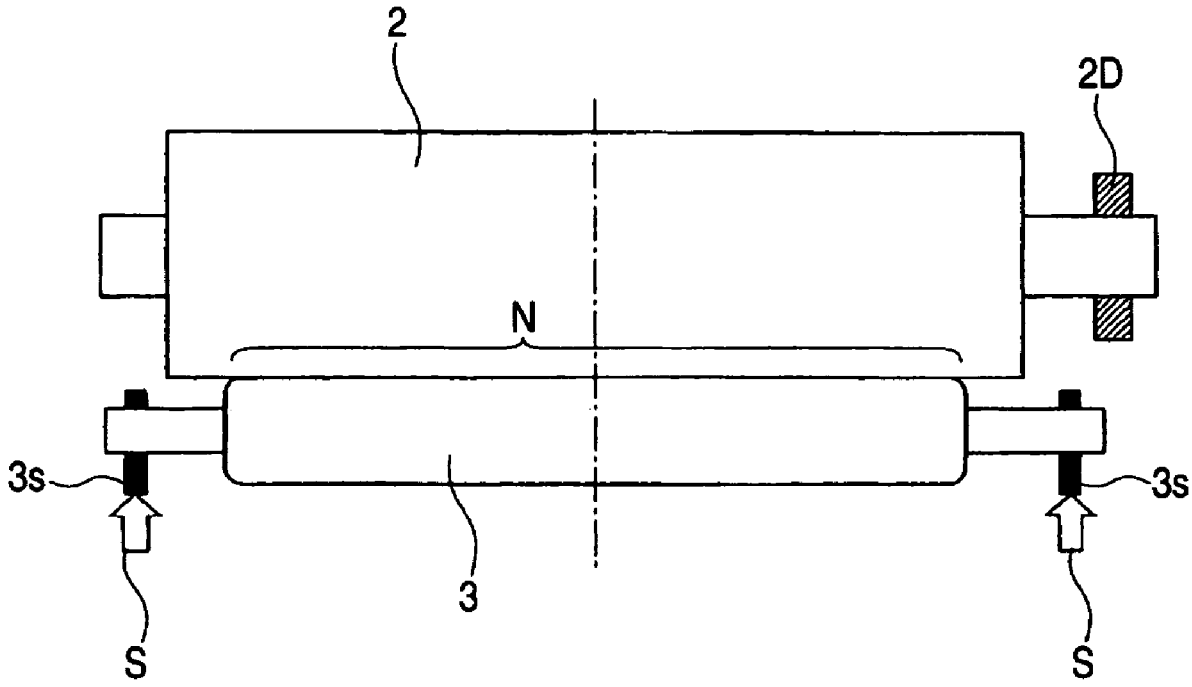
FIG. 2 is an illustration schematically showing an arrangement of a charging roll according to an exemplary embodiment of the invention.
Figure 3:
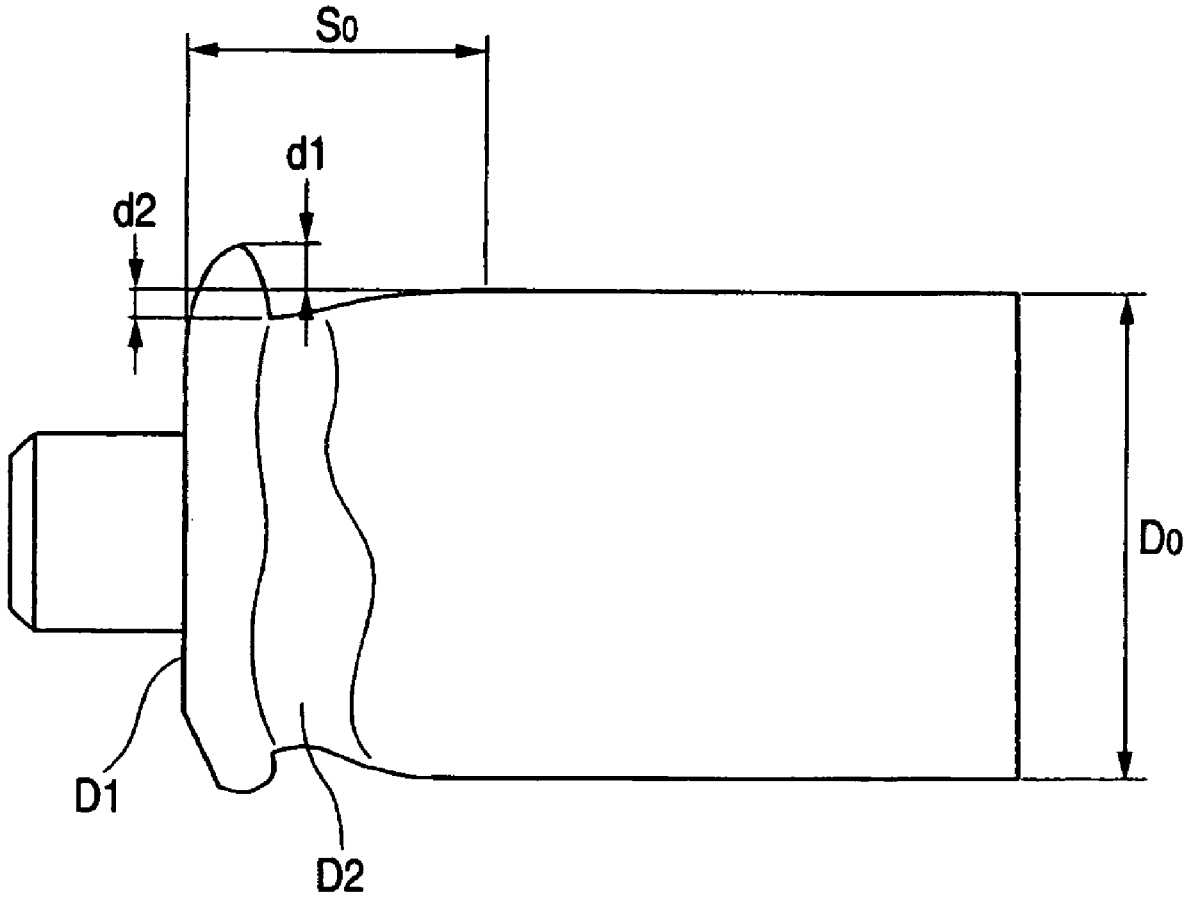
FIG. 3 is an enlarged view schematically showing an end part in an axial direction of a charging roll according to an exemplary embodiment of the invention.

The constitution of the charging roll according to an exemplary embodiment of the invention will be described in more detail with reference to FIGS. 2 and 3. FIG. 2 is an illustration schematically showing an arrangement of a charging roll according to the exemplary embodiment of the invention, and FIG. 3 is an enlarged view schematically showing an end part in the axial direction of the charging roll according to the exemplary embodiment of the invention. The image forming units 1Y to 1K have the similar constitution, and the constitutional devices thereof (such as the photoreceptor drums 2Y to 2K) also have the similar structures. Accordingly, the symbols therefor is referred by the generic symbol (such as the photoreceptor drum 2) for simplification.

As shown in FIG. 2, the charging roll 3 according to the exemplary embodiment is connected to a driving power source, which is not shown in the figure, via a driving gear 2D, and is made in contact with a surface of a photoreceptor drum 2, which is rotatably driven, so as to function as a contact charging roll, to which a predetermined bias voltage/current is applied from a high voltage power source, which is not shown in the figure.

The charging roll 3 is supported by bearing members 3*s*, and is pressed from under the bearing members 3*s* with pressing springs S, whereby the charging roll 3 is made in contact with the photoreceptor drum 2 at prescribed load and bite amount to form a nip part (press contact part) N. The charging roll 3 is driven by the rotation of the photoreceptor drum 2 through friction at the nip part N to rotate at the same rotation speed as the photoreceptor drum 2.

The charging roll 3 contains a roll member, which is constituted by a core metal formed of a metal, such as stainless steel, having coated thereon a conductive elastic layer formed of a conductive synthetic resin or synthetic rubber, and a resistance controlling layer, which is controlled to have a prescribed resistance value, is accumulated on the surface of the roll member. A releasing layer is formed on the surface of the resistance controlling layer depending on necessity. The core metal is applied, for example, with an alternating current voltage having a direct current voltage accumulated thereon, whereby gap discharge is formed in the minute gap between the charging roll 3 and the photoreceptor drum 2, and the surface of the photoreceptor drum 2 is uniformly charged with the discharge.

Upon forming the charging roll 3, in general, a high surface accuracy is demanded. In particular, formation of a uniform resistance controlling layer over the axially end parts (edge parts) is not easy but requires a special polishing process or an exclusive processing apparatus, which brings about increase in cost.

In order to eliminate the use of the special polishing process and the exclusive processing apparatus to reduce cost, such a method has been known that after forming a resistance controlling layer on a roll member having a conductive elastic layer coated thereon except for the axially end parts, a resistance controlling layer is coated only on the edge parts, and then a resistance controlling layer and, depending on necessity, a releasing layer are accumulated over the entire roll member.

In the case where the aforementioned method is employed, however, minute concave and convex parts D1 and D2 are necessarily formed in the axially end parts of the charging roll 3 corresponding to non-image forming area $S_0$ of the photoreceptor drum 2, as shown in FIG. 3. Specifically, the convex part D1 (large diameter part) is formed at endmost parts in the axial direction, and the concave part D2 (small diameter part) is formed axially inside the convex part D1 since a resistance controlling layer is formed except for the axially end parts, and then a resistance controlling layer is coated only on the axially end parts.

In the case where the concave and convex parts D1 and D2 are formed on the charging roll 3 in the non-image forming area $S_0$, in general, the quality of the formed image is not directly influenced thereby, but a gap is formed between the charging roll 3 and the photoreceptor drum 2 to form air discharge (concentric discharge) in these parts (particularly in the concave part D2), whereby wear deterioration of the photoreceptor drum 2 is accelerated with the lapse of time, which brings about such disadvantages as image defects, such as black stripes due to leakage, and reduction in service life of the photoreceptor.

However, it has been found by the inventors that the occurrence of the disadvantages due to the concave and convex parts D1 and D2 depends on the ratios between the dimensions of the concave and convex parts D1 and D2 and the roll diameter $D_0$ (outer diameter of the center part of the charging roll), and the disadvantages can be prevented from occurring by making the height d1 (distance from the roll surface) of the convex part D1 and the depth d2 (distance from the roll surface) of the concave part D2 within a prescribed range with respect to the roll diameter $D_0$.

More specifically, the relationship of the occurrence of discharge with respect to the concave and convex amounts d1 and d2 of the end parts is measured to obtain such concave and convex amounts d1 and d2 of the end parts that do not invoke discharge. The measurement and the results obtained thereby will be described with reference to FIGS. 4, 5A and 5B.

A charging roll 3 having a roll diameter $D_0$ of 12 mm and a roll length of 310 mm is made in contact with a photoreceptor drum 2 in a stationary state, and a bias voltage containing a direct current bias component of DC −730 V and an alternating current bias component of AC 2.5 kV is applied thereto for 12 minutes with variation in nip load, whereby occurrence of discharge is observed. The measurement results are shown in FIG. 4.

It is understood from FIG. 4 that abnormal discharge occurs at the concave and convex parts in the case where any one of the concave and convex amounts d1 and d2 of the end parts exceeds 0.03 mm (which is 0.25% of the roll diameter $D_0$).

Figure 5A:
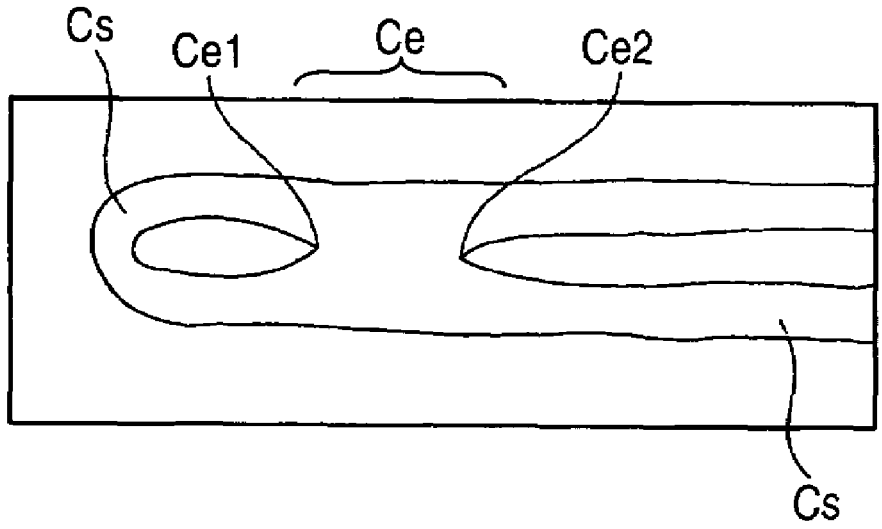
FIG. 5A RELATED ART
FIG. 5A is an illustration showing a measurement result of a discharge trace of a conventional charging roll.

FIG. 5A shows the discharge trace of the discharge occurring in the concave and convex parts.

In FIG. 5A, area denoted by symbol Cs is a discharge trace of normal discharge occurring in the prescribed discharge area in the vicinity of the nip area between the charging roll 3 and the photoreceptor drum 2. The area denoted by symbol Ce is an area showing abnormal discharge trace caused by the concave and convex parts D, and the discharge is concentrated to sharp ends $Ce_1$ and $Ce_2$ thereof, whereby the surface of the photoreceptor drum 2 is worn mainly at the sharp ends $Ce_1$ and $Ce_2$ at an accelerated rate.

It is also understood from FIG. 4 on the other hand that no abnormal discharge occurs or the discharge trace is improved (i.e., no sharp concentrated discharge part $Ce_1$ or $Ce_2$ occurs) in the case where any both the concave and convex amounts d1 and d2 of the end parts are 0.03 mm (which is 0.25% of the roll diameter $D_0$) or less. In particular, it is understood that completely no abnormal discharge occurs when the nip load is approximately 500 gf or more.

Figure 5B:
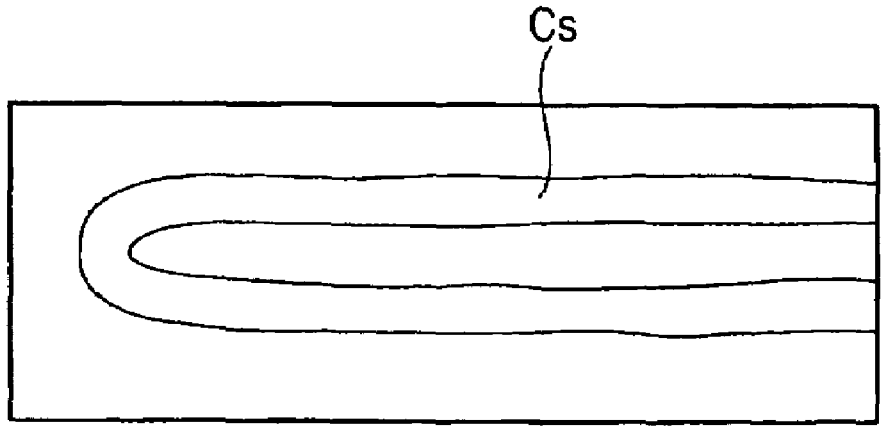
FIG. 5B is an illustration showing a measurement result of a discharge trace of a charging roll according to an exemplary embodiment of the invention.

FIG. 5B shows a discharge trace in the case where the concave and convex parts D1 and D2 are formed within the prescribed range.

It is understood from FIG. 5B that in the case where the concave and convex parts D1 and D2 are formed within a range of 0.25% or less of the roll diameter $D_0$, only a discharge trace Cs occurs, which shows stable normal discharge in the prescribed discharge area in the both end parts of the nip area between the charging roll 3 and the photoreceptor drum 2, but the abnormal discharge area Ce and the concentrated discharge parts $Ce_1$ and $Ce_2$, caused by the concave and convex parts D1 and D2 which are found in FIG. 5A, are completely not formed.

The concave and convex parts D1 and D2 within the prescribed range with respect to the roll diameter $D_0$ can be easily formed by controlling the coating amount of the resistance controlling layer or the releasing layer to be accumulated on the axially end parts, and the special polishing process or the exclusive processing apparatus, which have been conventionally required, can be omitted.

In consideration of such a standpoint that a uniform nip area is formed by stable contact with the photoreceptor drum 2 to stabilize the discharge, the charging roll preferably has a roll hardness (hardness of the elastic material formed on the surface thereof) of from approximately 60° to approximately 80° in Asker C hardness.

The foregoing description of the exemplary embodiments of the invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a rotatable image carrying member, on a surface of which an electrostatic latent image is formed, and a charging roll that is in contact with the image carrying member to charge the surface of the image carrying member to a prescribed potential, the charging roll having, in non-image forming areas in both end parts in an axial direction of the charging roll, large diameter parts having a larger outer diameter than an outer diameter of a center part of the charging roll, and small diameter parts having a smaller outer diameter than the outer diameter of the center part inside the large diameter parts in the axial direction, and differences in outer diameter of the large diameter part and the small diameter part from the outer diameter of the center part each being 0.25% or less and more than 0% of the outer diameter of the center part.

2. The image forming apparatus as claimed in 1, wherein the charging roll is in contact with the image carrying member at a load of 500 gf or more.

3. The image forming apparatus as claimed in claim 1, wherein the charging roll comprises an elastic material at least on a surface thereof, and the elastic material has a hardness of from 60° to 80° in Asker C hardness.

4. A method for producing a charging roll that is in contact with an image carrying member to charge a surface of the image carrying member to a prescribed potential, the method comprising:

providing, in both end parts in an axial direction of a roll corresponding to non-image forming areas of the image carrying member, large diameter parts having a larger outer diameter than an outer diameter of a center part in the axial direction; and providing, at an inside of the large diameter parts in the axial direction, small diameter parts having a smaller outer diameter than the outer diameter of the center part in the axial direction, a difference in outer diameter of the large diameter part from the outer diameter of the center part in the axial direction being 0.25% or less and more than 0% of the outer diameter of the center part, and a difference in outer diameter of the small diameter part from the outer diameter of the center part in the axial direction being 0.25% or less and more than 0% of the outer diameter of the center part.

5. The method for producing a charging roll as claimed in 4, wherein at least a surface of the roll comprises an elastic material, and the elastic material has a hardness of from 60° to 80° in Asker C hardness.

* * * * *